United States Patent [19]

Marquart

[11] Patent Number: 4,656,797

[45] Date of Patent: Apr. 14, 1987

[54] PREFABRICATED HOME FOUNDATION SKIRT SYSTEM

[76] Inventor: Clark M. Marquart, 6923 Storm Lake Rd., Snohomish, Wash. 98290

[21] Appl. No.: 818,015

[22] Filed: Jan. 13, 1986

[51] Int. Cl.[4] ..... B60R 27/00; E04B 1/04

[52] U.S. Cl. ..... 52/169.12; 52/592; 52/600; 52/DIG. 3

[58] Field of Search ..... 52/169.12, DIG. 3, 294, 52/169.11, 592, 596, 600, 309.12, 293, 541, 610

[56] References Cited

U.S. PATENT DOCUMENTS

| | | | |
|---|---|---|---|
| 3,492,767 | 2/1970 | Pincus | 52/294 X |
| 3,605,353 | 9/1971 | Marcott | 52/600 X |
| 3,818,658 | 6/1974 | Slaven | 52/600 X |
| 3,916,587 | 11/1975 | Cox | 52/DIG. 3 |
| 4,137,684 | 2/1979 | Shennan | 52/602 |
| 4,241,554 | 12/1980 | Infantino | 52/DIG. 3 |
| 4,512,126 | 4/1985 | Walston | 52/309.12 X |
| 4,565,044 | 1/1986 | Takahara | 52/294 X |
| 4,570,398 | 2/1986 | Zimmerman | 52/169.11 |

FOREIGN PATENT DOCUMENTS

| | | | |
|---|---|---|---|
| 318322 | 6/1934 | Italy | 52/592 |

*Primary Examiner*—J. Karl Bell
*Attorney, Agent, or Firm*—Dowrey & Cross

[57] ABSTRACT

A concrete skirting system for a prefabricated structure, such as a modular prefabricated home, comprises a plurality of rectangular precast concrete skirt modules. Each module consists of a rectangular panel extended upward from an integral footing. The panel is of thin, reinforced concrete construction with integral ribs on the inner panel surface which faces into the crawl space beneath the structure. The modules are provided with rabbeted side edges which form a rabbet joint when adjacent modules are installed beneath the lower peripheral edge of the structure. A concrete mold is provided to produce the precast modules.

4 Claims, 3 Drawing Figures

PREFABRICATED HOME FOUNDATION SKIRT SYSTEM

FIELD OF THE INVENTION

This application relates to concrete foundation systems and more particularly to concrete skirting wall systems for pre-manufactured structures.

BACKGROUND OF THE INVENTION

Pre-manufactured structures such as so-called "mobile" homes or modular homes and the like are commonly installed by being placed on concrete or cinder block piers. Typically, the peripheral lower edges of these structures are unsupported. The gap between these edges and the ground may be covered by a non-load bearing skirt fabricated from metal or synthetic materials simply to provide a more pleasing appearance. Over extended periods of time, the peripheral edges of these buildings may warp, sag or buckle. The skirts are not structurally sufficient to prevent this form of deterioration.

SUMMARY OF THE INVENTION

This invention provides a skirting system for "mobile" or modular homes and like buildings that has sufficient structural strength to support and reinforce the lower peripheral edges of the buildings. The skirting system of this invention is composed of skirt modules designed to be positioned beneath the lower peripheral edge of a building, after the building has been mounted on pier blocks, columns or the like. These skirt modules interface with one another to provide a continuous jointed peripheral outer surface of pleasing appearance and to provide a structurally integral load-bearing skirt wall. Various of the skirt modules may be provided with access doorways or windows to afford access to the crawl space beneath the building, or to ventilate the crawl space.

A concrete skirting system for a prefabricated structure, such as a modular prefabricated home, comprises a plurality of rectangular precast concrete skirt modules. Each module consists of a rectangular panel extended upward from an integral footing. The panel is of thin, reinforced concrete construction with integral ribs on the inner panel surface which faces into the crawl space beneath the structure. The modules are provided with rabbeted side edges which form a rabbet joint when adjacent modules are installed beneath the lower peripheral edge of the structure. A concrete mold is provided to produce the precast modules.

DETAILED DESCRIPTION OF THE DRAWINGS

DETAILED DESCRIPTION OF THE INVENTION

Figure 1:
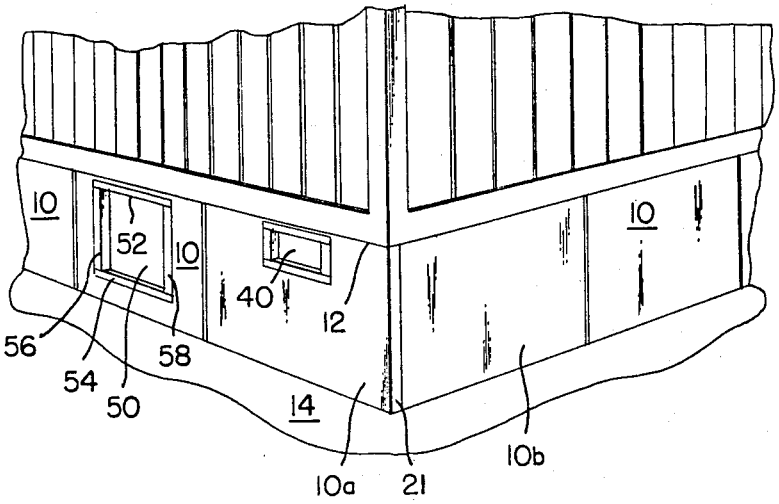
FIG. 1 is a perspective view of a corner of a premanufactured building with the skirting system installed.
Figure 2:
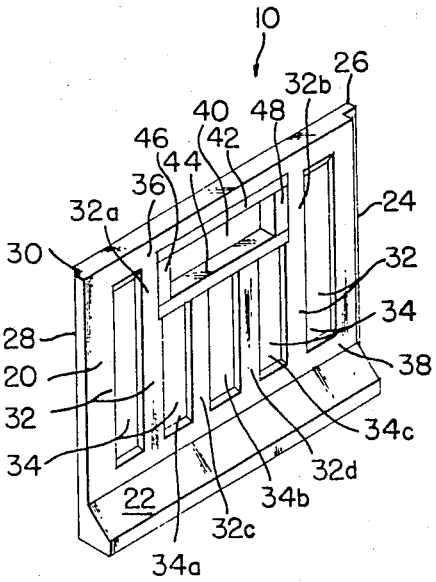
FIG. 2 is a perspective view of a typical concrete skirt module.
Figure 3:
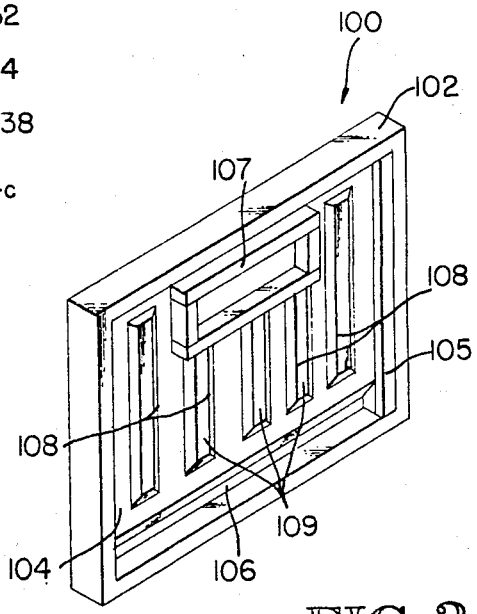
FIG. 3 is a perspective view of a concrete form in which the FIG. 2 module was cast.

The skirting system of the present invention comprises a plurality of concrete skirt modules 10 positioned edge-to-edge beneath the lower peripheral edge 12 of a pre-fabricated structure. The modules are wedged up against the underside of the structure's frame and concrete 14 is puddled around and under the modules. When the puddled concrete is set, the modules become load bearing and help support the structure.

The skirt modules preferably are of uniform dimension, approximately 27 inches high and 48 inches wide. Each module 10 is a panel 20 with a main thickness of 1½ inches, and a footing 22 having a base thickness of 3½ inches and a minimum height of 1½ inches. The side edges of each module are rabbeted, one edge 24 to provide an outer flange 26 with a cut-out facing inward and the other edge 28 to provide an inner flange 30 with a cut-out facing outward. The modules are cast such that the upper surface footing of 22 tapers to the inside surface of panel 20 with a slope of 315° from the vertical. The footing 22 extends inward, rather than outward, so that the outer surface of each module is co-planar.

When the modules are installed edge-to-edge, the adjacent rabbeted edges overlap. To insure a good abutting contact, the outer flange 26 of one module is wider than the interfitting inner flange 30 of an adjacent modules. Suitable widths would be 1 inch for the outer flanges 26 and ¾ inch for the inner flanges 30. With these dimensions a module would be 48¾ inches wide, with an exposed outer surface 48 inches wide. The outer flanges 26 are of the same dimensions as the inner flange cut-outs so that the installed panels provide a co-planar skirt. Preferably, the flanges and cut-outs are ¾ inch thick. The footing 22 extends to the edge of the inner flange 30 but extends only to the edge of the outer flange cut-out. Thus, outer flange 26 extends the full height of the module and the footing 22 reinforces the lower part of the inner flange 30.

The inner surface of a typical panel 20 comprises a plurality of vertical reinforcing ribs 32 separated by vertical recesses 34. A typical panel will have eight vertical ribs 32, each 2 inches wide, linked together by top and bottom horizontal ribs 36 and 38. Where necessary, additional horizontal ribs may be provided in between the top and bottom ribs 36 and 38. The vertical recesses 34 are preferably ¾ inch deep, one half the panel main thickness of 1½ inches. The top rib 36 is preferably 2 inches wide and the bottom rib is preferably ¾ inch wide. The recesses 34 are typically 3⅝ inches wide at the panel inner surface and have edges beveled at 45°.

Corner modules have somewhat modified corner edges. A pair of modules form the skirting 90° corner. One 10*a* of the pair has a plain unrabbeted corner edge 21 of full thickness. That one module, however, has a shortened footing recessed back from the module corner edge by an amount slightly greater than the footing width, typically about 4½ inches. The other 10*b* of the pair also has a plain unrabbeted corner edge of full thickness with a footing that extends to the corner edge. This latter module 10*b* of the pair is butted into the inner panel surface of the first module 10*a* with the footings of the second module 10*b* extending past the shortened footing of the first module 10*a*, and butting up against the inner panel surface of the first module 10*a*.

One or more of the modules may be provided with a vent opening 40. The vent opening is defined by horizontal framing members 42 and 44 blocked apart by vertical framing members 46 and 48. Framing members 42, 44, 46 and 48 may be fabricated from a variety of materials such as steel, aluminum, plaster or wood. For convenience, further reference herein will be to "wood" members. For panels having a main thickness of 1½ inches, the framing members may be 2 inches×2 inches dimensional lumber, having actual dimensions of about 1½ inches×1½ inches. The vent opening preferably would be sized such that the vertical wood members 46 and 48 are confined by vertical ribs 32*a* and 32*b*, and horizontal wood member 42 is confined by top rib 36. A typical vent opening would be 7 inches by 16 inches. Vertical ribs that would otherwise extend through the vent opening are shortened as at 32*c* and 32*d* and so too are the vertical recesses as at 34*a*, 34*b* and 34*c*. These intermediate vertical ribs 32*c* and 32*d* provide support for horizontal wood member 44.

After installation, should these wood members that frame the vent opening rot out or otherwise require replacement. replacement could be easily accomplished. The existing wood members would be knocked out and new top and bottom placed in position and secured therein by wedging new side members between them. Appropriate screening can be secured to the inside or outside of the vent opening frame as desired.

One or more modules may be provided with a crawl space access opening 50. The access opening is defined by top, bottom and side wood members 52, 54, 56 and 58 which are installed in the same manner as the wood frame for the access opening 40. For panels having a main thickness of 1½ inches, the wood members may be 2 inches×2 inches dimensional lumber, having actual dimensions of about 1½ inches×1½ inches. The access opening preferably would be sized such that the vertical wood members 56 and 58 are confined by vertical ribs, and horizontal wood member 52 is confined by the top rib, as in the case of the frame for the vent opening 40. A typical access opening would be 18 inches×26 inches. For this size access opening, the inner panel surface between the bottom wood member 54 and the sloped surface of the footing would be uninterrupted by recesses; the bottom wood member 58 being confined by the bottom horizontal rib. The access opening frame can be replaced in the same manner as described with respect to the vent opening frame.

These concrete skirt modules can be cast in a mold 100. Mold 100 comprises a frame 102, an inside panel surface base 104, and a footing section 106. The maximum width of the frame 102 for the preferred skirt module size is 3½ inches, the approximate width of 2×4 dimensional lumber. The base 104 is mounted within frame 102 at a position where the distance between the base 104 and the exposed edge of frame 102 is 1½ inches, the main thickness of the module panel. Fillers or spacers 108 are mounted to the base 104 to provide for the panel recesses described previously. A typical spacer is ¾ inch thick and 3⅜ inches wide with edges beveled at 45°.

Rabbet joint spacers 105 are secured to opposite sides of the mold frame. One such spacer is secured to the exposed edge of one frame side and the other is secured to the base adjacent the other side. This positioning will provide the inner-outer configuration of the panel flanges described previously.

Prior to filling the mold 100 with concrete, reinforcing is laid up in the form of top and bottom rebar steel rods and a welded wire reinforcing mesh. One rebar rod is positioned for containment in the panel top rib, and the other rebar rod is positioned for containment in the footing. The wire mesh, typically having a 6 inch mesh, is laid across the fillers and between the sides of the frame 102. When the mold is filled with concrete, the rebar rods and wire mesh are re-positioned to lay fully embedded in the concrete. If a decorative outer panel surface is desired, the same may be provided at this time. An exposed aggregate finish, for example, could be provided by washing or brushing the surface to expose the aggregate in the concrete mix by seeding the panel surface with additional aggregate. Likewise, a press plate may be applied to indent a design into the unset outer panel surface The mold 100 is laid down with the open frame facing upward for filling. Concrete is filled to the top of the exposed edges of frame 102. The concrete is struck off smooth with the top of the frame and troweled to a smooth finish, this exposed concrete surface being the outer panel surface of the skirt module.

To produce a module having a vent opening, a 1½ inch×1½ inch vent opening frame 107 is laid up and positioned on the mold base 104 at the desired location. In this case, shortened intermediate fillers 109, with unbeveled top edges, are secured to the base 104 and the vent opening frame is butted against these filler top edges. The vent opening frame 107 extends upward from the base 104 the same distance as the mold frame 102. Steel rebar rods are positioned as described previously and a welded wire mesh is laid in place around the vent opening frame. Concrete is filled to the top of the mold frame 102 and struck off flush with the mold frame top and the top edges of vent opening frame 107. A module having an access opening would be produced in a similar manner except that no shortened intermediate fillers would be employed.

An alternative mold arrangement may be used to provide multiple horizontal ribs as well as vertical ribs on the inner panel surface. To achieve this, rather than employing elongated vertical fillers or spacers as at 108, rectangular or square fillers may be secured to base 104 in rows and columns. Employing square fillers about 4 inches×4 inches would produce a waffle appearance to the mold. The resulting skirt module would be provided with equally-spaced, intersecting vertical and horizontal ribs. The inner panel surface would thus also have a waffle appearance.

A typical installation would take place as follows. A pre-fabricated structure would be in place and supported at several locations by pier blocks or the like. The lower peripheral edge of the structure, which would be a framework of some sort, would be exposed about 2½ feet above the ground level. Appropriate plumbing and wiring would have been installed. The ground below the edge of the structure would be cleared and leveled. Installation of the skirting would then commence. The skirt modules would be installed, one by one with adjacent modules interlocked in abutment with one another.

As each module is positioned in place, it would be blocked up so that the footing would be off the ground and the top edge with the panel firmly seated up against the peripheral edge of the overhead structure. After all the modules were installed in this fashion, concrete would be poured along the base of the interlocked module footings and spread beneath the footings, to a depth of about 3 inches. When the concrete set, the skirt modules would become load bearing to an extent sufficient to maintain the integrity of the overhead periphery of the pre-fabricated structure.

The result is an attractive skirting that seals off the underside of the structure and provides an appearance that belies the fact that the structure is otherwise supported by blocks or piers. Since modular, pre-fabricated homes are often installed as permanent dwellings, the use of this invention enhances the overall appearance of the home. The use of this invention as described is substantially less costly than building a concrete foundation to code secifications. Moreover, this invention can be employed to finish out existing home installations where the building of a concrete foundation would be inappropriate or not economically feasible.

While the invention has been described with reference to particular embodiments, it will be apparent to those skilled in the art that variations of these embodiments may be made within the scope if the invention.

I claim:

1. A modular load bearable skirting system for premanufactured homes and building structures supported in an elevated position which comprises a plurality of rectangular concrete skirt modules positioned in side-by-side adjancy beneath and in contact with the lower peripheral edge of such a building structure; each module having a length greater than its height, and thin panel making up most of its size with a top edge abutting the overhead building structure lower peripheral edge, and a footing integral with and thicker than the panel supporting the module, the side edges of each panel being rabetted so as to provide an inner vertical flange on one edge and outer vertical flange on its other edge with adjacent panel edges abutting in vertical rabbet joints.

2. The system of claim 1 wherein the inner surface of each panel is ribbed to strengthen the panel with the footing extending outwardly beyond the panel ribbing.

3. The system of claim 1 wherein the panel edge flanges extend the full height of each module with one edge flange being slightly wider than the other edge flange.

4. The system of claim 1 wherein a vent opening frame is encased in the concrete panel with panel inner surface ribs abutting the frame.

* * * * *